US006345393B1

(12) United States Patent
Bayer

(10) Patent No.: US 6,345,393 B1
(45) Date of Patent: Feb. 12, 2002

(54) FOUR-SIDED DOUBLE REVERSIBLE HUNTER'S COAT

(76) Inventor: John J. Bayer, 124 Lawrence Ave., Bulter, PA (US) 16001

( * ) Notice: Subject to any disclaimer, the term of this patent is extended or adjusted under 35 U.S.C. 154(b) by 0 days.

(21) Appl. No.: 09/548,869

(22) Filed: Apr. 13, 2000

(51) Int. Cl.[7] ..... A41D 1/00
(52) U.S. Cl. ..... 2/94; 2/DIG. 2
(58) Field of Search ..... 2/94, 97, 69, 79, 2/85–86, 89, 115, 227, 93, 102, 172, 243.1, DIG. 2

(56) References Cited

U.S. PATENT DOCUMENTS 2,412,988 A * 12/1946 Kleinman ..... 2/93
2,711,539 A * 6/1955 Loscher ..... 2/93
4,472,835 A * 9/1984 Clark ..... 2/102
5,029,344 A * 7/1991 Shannon et al. ..... 2/69

* cited by examiner

*Primary Examiner*—John J. Calvert
*Assistant Examiner*—Tejash Patel
(74) *Attorney, Agent, or Firm*—John D. Gugliotta; Michael J. Corrigan

(57) ABSTRACT

The invention is an outdoorsmen style hunter's coat manufactured so that any one of four camouflage styles can be worn on the outer side. There is a spring, summer, fall, and winter camouflage style that can be worn as appropriate. Two nearly identical coat shells are stitched together on all sides. Each of the shells has one of the camouflage patterns printed on each side. The first two patterns are worn chosen by reversing the coat as with conventional reversible garments. The remaining two patterns can be worn by pulling the inner coat shell through a zippered slit formed in the back of the coat from beneath the shoulder to just above the waist. The coat is also provided with large, gusseted pockets with flaps secured by hook and loop fasteners.

6 Claims, 6 Drawing Sheets

FOUR-SIDED DOUBLE REVERSIBLE HUNTER'S COAT

RELATED APPLICATIONS

The present invention was first described in Disclosure Document Number 463,936 filed on Oct. 21, 1999. There are no previously filed, nor currently any co-pending applications, anywhere in the world.

BACKGROUND OF THE INVENTION

1. Field of the Invention

The present invention relates generally to outdoor clothing and, more particularly, to a four-sided double reversible hunter's coat that has four different camouflage patterns that can be worn during hunting.

2. Description of the Related Art

Hunting and fishing are as old as humankind itself. Early man hunted in order to eat and survive. Hunter's devised a variety of tools and equipment to aid in the hunt. Of great importance in a successful hunt was the need to quickly and invisibly approach the game in order to get a clear shot. Hunter's eventually devised a variety of clothing to help keep themselves warm. It became popular to manufacture hunting clothing with patterns printed on the outer layer to help conceal the hunter from the game. Hunting as a necessity eventually has diminished but hunting as a sport has continued with great popularity. Everyone has seen hunter's wearing outdoor jackets and pants in the popular orange and green camouflage patterns. One can choose from many different style and colors of these patterns for the different times of the year. As the seasons change it is desirable to have the camouflage pattern more closely match the foliage. This can require a hunter to purchase many different hunting jackets and pants and the like. This can become quite expensive for the average hunter.

Consequently, a need has been felt for a hunting jacket that has multiple camouflage patterns available for the hunter to wear. The development of the four sided double reversible hunter's coat fulfills this need.

In the related art, there exists patents for garments that have reversible outer layers and methods for reversing the outer layer. Included with these patents are garments specifically designed for hunter's having reversible outer layers. However, none of these garments are for a four-sided double reversible garment as in the present invention. More importantly, and of considerable relevance is U.S. Pat. No. 5,029,344 issued in the name of Shannon et al. which discloses a double reversible garment. The garment in Shannon et al. is disclosed as being a coat or skirt but is not specifically intended to be a hunter's garment. Additionally, the garment in Shannon et al. uses a flexible strip as the coupling means to hold together the edges of at least one edge pair of the twin sheet members. This is in contrast to the double shell design in the present invention wherein the edges of the shells are stitched together and the garment is double reversed by pulling the inner shell through the outer shell through a zippered slit in the back of the garment. The garment in Shannon et al. has no such zipper and is reversed differently.

A search of the prior art did not disclose any patents that read directly on the claims of the instant invention; however, the following references were considered related:

| U.S. Pat. No. | Inventor | Issue Date |
|---|---|---|
| 5,159,718 | Moyer | Nov. 3, 1992 |
| 4,700,409 | De Lott | Oct. 20, 1987 |
| 4,476,587 | Itoi | Oct. 16, 1984 |
| 4,338,686 | Bell | Jul. 13, 1982 |
| 4,316,288 | Henrickson. | Feb. 23, 1982 |
| 3,710,394 | Trice | Jan. 16, 1973 |
| 3,492,676 | King | Feb. 3, 1970 |
| 5,029,344 | Shannon et al. | Jul. 9, 1991 |

Consequently, a need has been felt for providing a four sided double reversible hunter's and an improved method wherein the inner and outer shell are reversed to reveal additional outer layers of the coat.

SUMMARY OF THE INVENTION

It is therefore an object of the present invention to provide a outdoor hunter's coat having four possible outer fabric styles.

It is another object of the present invention to provide a coat with four different camouflage schemes that can be worn for a variety of hunting and fishing conditions during spring, summer, fall and winter.

It is another object of the present invention to be waterproof to keep the wearer warm and dry.

It is a feature of the present invention that the coat is reversible in that one of two sides can be chosen to be worn and double reversible in that an additional two sides can be chosen to be worn by pulling the inner coat layer through a zipper in the back of the coat.

It is a feature of the present invention to provide large, gusseted pockets with flaps secured by hook and loop fasteners.

Briefly described according to one embodiment of the present invention, a four sided double reversible coat is provided. Essentially, the invention is a outdoors style coat manufactured so that any one of four camouflage styles can be worn on the outer side. There is a spring, summer, fall, and winter camouflage style that can be worn as appropriate. Two nearly identical coat shells are stitched together on all sides. Each of the shells has one of the camouflage patterns printed on each side. The first two patterns are worn by reversing the coat as with conventional reversible garments. To use the second pattern the coat is turned inside out so that the inner layer is now exposed. The outer layer now serves as the inner layer. The remaining two patterns can be worn by pulling the inner coat shell through a zippered slit formed in the back of the coat from beneath the shoulder to just above the waist. The coat is also provided with large, gusseted pockets with flaps secured by hook and loop fasteners.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

The best mode for carrying out the invention is presented in terms of its preferred embodiment, herein depicted within the Figures.

1. Detailed Description of the Figures

Figure 1:
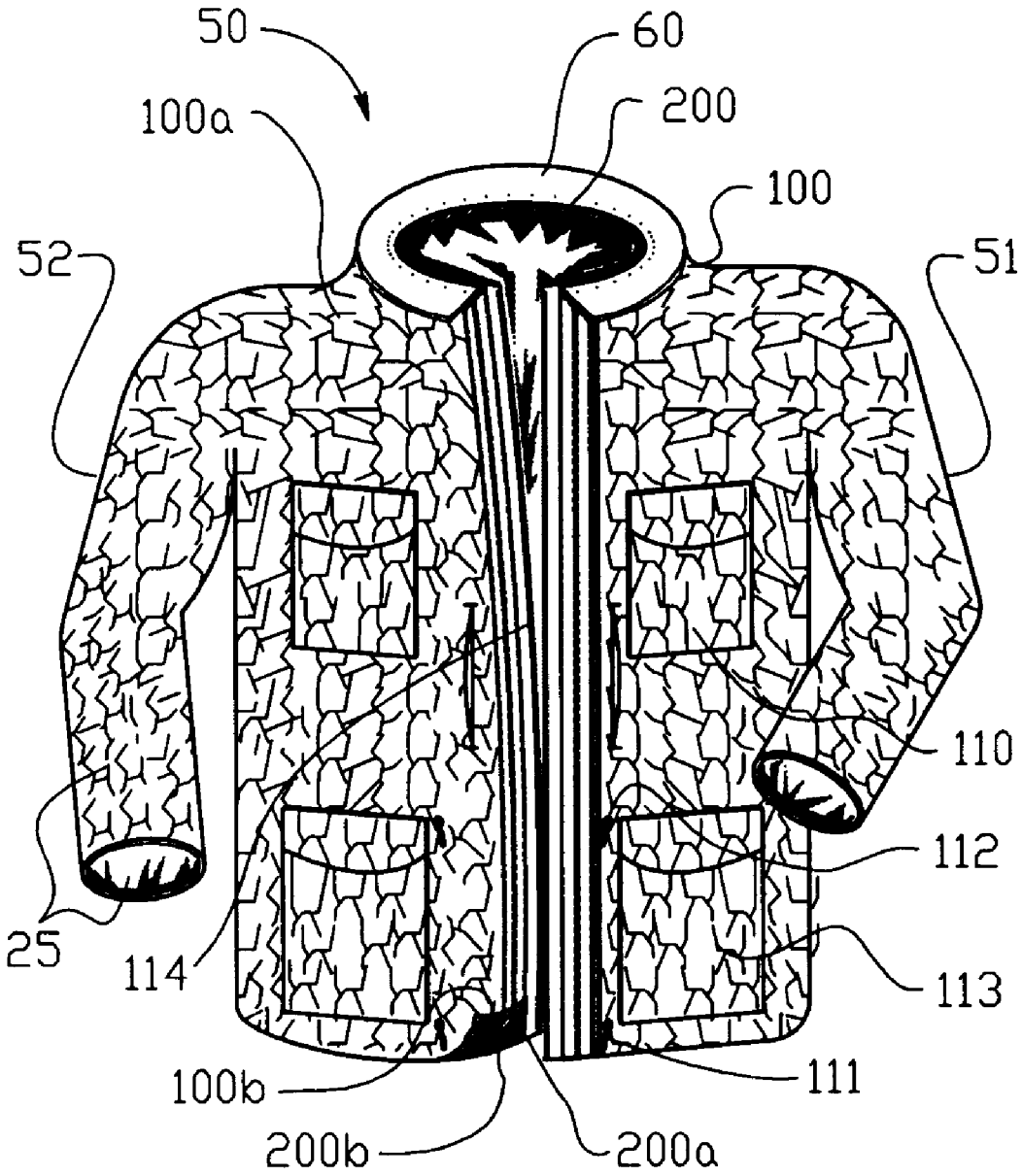
FIG. 1 is a perspective view of a four sided double reversible hunter's coat, according to the preferred embodiment of the present invention.

Referring now to FIG. 1, a four-sided double reversible coat 50 is shown, according to the present invention, having four different patterns that can be selectively worn and chosen according to the wearer=s taste and desire. It is envisioned that the coat 50 would be a hunter=s jacket having four different camouflage 25 styles that are typically associated with the seasons of spring, summer, fall, and winter. Two of the patterns are printed on a first shell 100, one pattern printed on the outer surface 100*a* and the other printed on the inner surface 100*b*. The remaining two patterns are printed on a second shell 200, one pattern printed on the outer surface 200 a and one printed on the inner surface 200*b*. The first shell 100 and second shell 200 are essentially identical in shape except for differences related to the double reversible nature of the coat 50. In all possible configurations of the coat 50, four large, rectangular-shaped pockets with flaps secured by hook and loop fasteners are located on the front of the coat. Two of the pockets are upper pockets 110 located on either side of a central first zipper 120 in the breast area. Two of the pockets are lower pockets 113 located on either side of central zipper 120 located in the abdomen area. Also located on the front of coat 50 in each of the possible four configurations are a pair of drawstrings 111 penetrating each shell 100, 200 by a series of four brass grommets 112, allowing for conventional drawstring function.

Each shell 100, 200 is formed nearly identically to each other, and each is formed with a left sleeve 51 opposite the central zipper 120 to the right sleeve 52. Further, the central zipper 120 has a flap 114 that overlays the zipper 120, and is formed of a linearly elongated tab-like structure extending laterally inward from the inner seam of the shell 100 (and 200).

Figure 2:
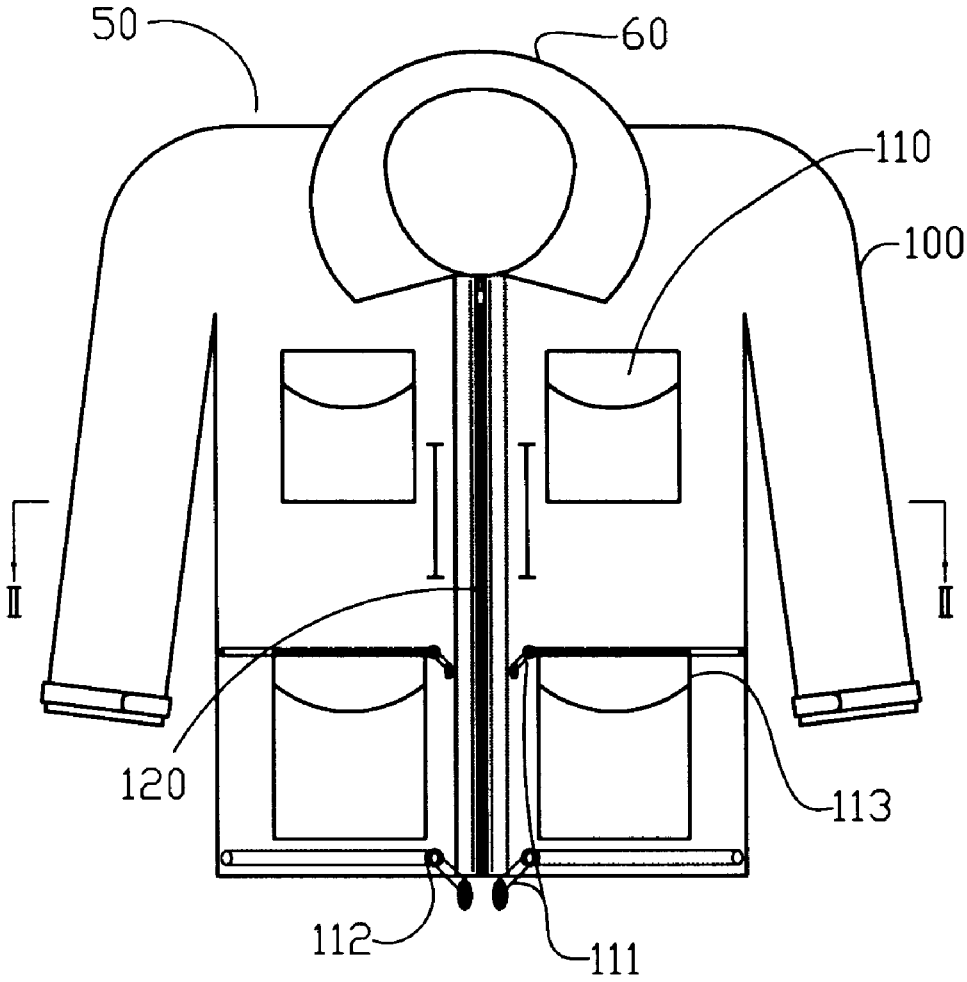
FIG. 2 is an exploded perspective view of a four sided double reversible hunter's coat wherein the inner shell is partially removed from the outer shell, according to the preferred embodiment of the present invention.

Referring to FIG. 2, the first shell 100 of the coat 50 is shown in greater detail. For purposes of the functionality of the present invention, the first shell 100 has an outer surface that forms a first camouflage 25 pattern specific to a summer camouflage pattern, such as a conventional tan dessert camouflage pattern, and an inner surface that forms a second camouflage 25 pattern specific to a spring camouflage pattern, such as a conventional green forest camouflage pattern. Formed in a conventional jacket configuration having a pair of separate front breast panels connected by a reversible zipper, the outer surface forms a zipper flap that extends past one breast panel to cover the zipper when closed. A collar 60 extends outward from a neck hole formed by the coat 50. Inevitably, the seam connection formed at the collar 60 has the first camouflage 25 pattern in the inside surface of the collar 60 and the second camouflage 25 pattern on the outside surface of the collar 60.

On the upper surface of each breast panel is formed an upper pocket 110. Each upper pocket 110 is formed of a patch affixed to the outer surface of the first shell 100 attached over an orifice penetrating the first shell 100. Similarly, a patch is affixed over the orifice penetrating the first shell 100 on the inner surface. Each patch is sealed on three sides, with a pocket flap attached along the upper opening such as to fold downward over the upper pocket opening. This similar configuration on each of the inside surface and outside surface allows each upper pocket 110 to have an outer access to a common inner pocket volume regardless of which surface is positioned to the outside. In order to maintain the contents of each upper pocket 110 during the process of reversing the coat, each flap is secured to the pocket 110 by use of a conventional fastener, envisioned as a hook and loop fastener.

On the lower surface of each breast panel is formed an lower pocket 113. Each lower pocket 113 is formed of a patch affixed to the outer surface of the first shell 100 attached over an orifice penetrating the first shell 100. Similarly, a patch is affixed over the orifice penetrating the first shell 100 on the inner surface. Each patch is sealed on three sides, with a pocket flap attached along the upper opening such as to fold downward over the upper pocket opening. This similar configuration on each of the inside surface and outside surface allows each lower pocket 113 to have an outer access to a common inner pocket volume regardless of which surface is positioned to the outside. In order to maintain the contents of each lower pocket 113 during the process of reversing the coat, each flap is secured to the pocket 113 by use of a conventional fastener, envisioned as a hook and loop fastener.

Similarly, the second shell 200 has an outer surface that forms a third camouflage 25 pattern specific to a winter camouflage pattern, such as a conventional white winter camouflage pattern, and an inner surface that forms a pattern specific to hunting such as a safety orange, or conventional DAY-GLO(tm) orange camouflage pattern.

Figure 3:
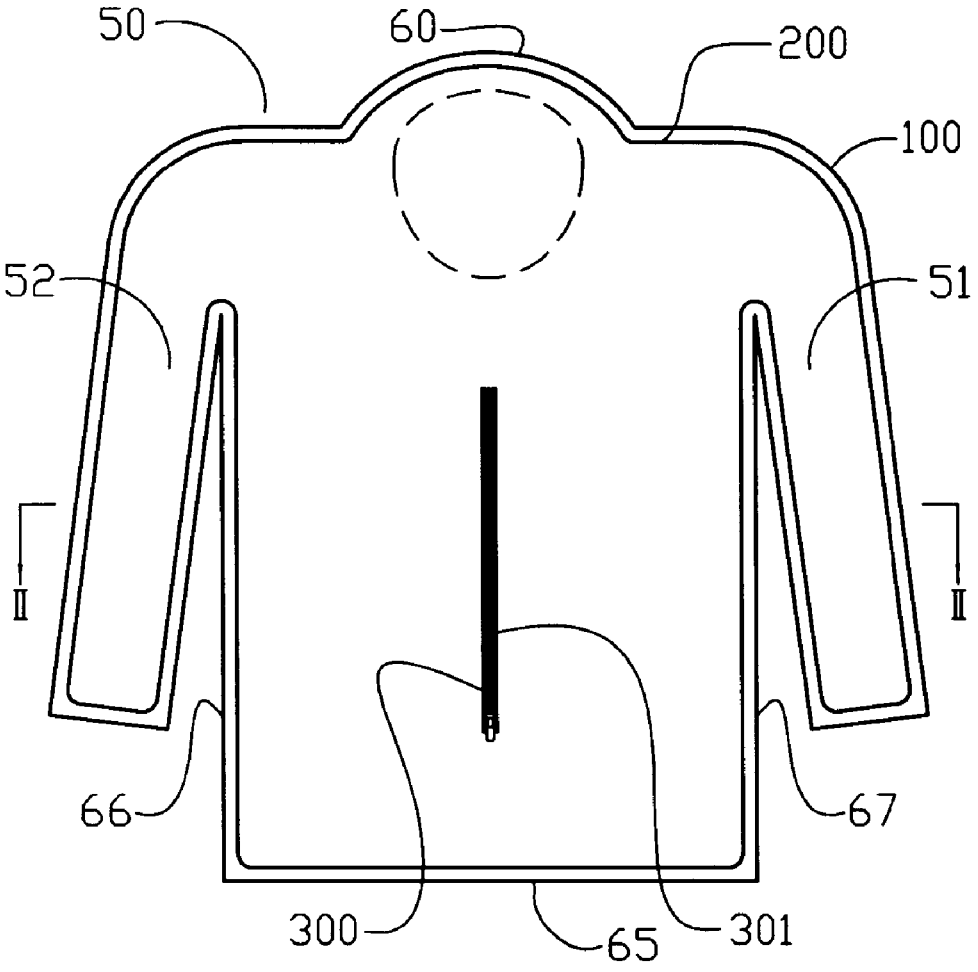
FIG. 3 is a rear view of an outer shell 200 of the four sided double reversible hunter's coat, according to the preferred embodiment of the present invention.
Figure 4:
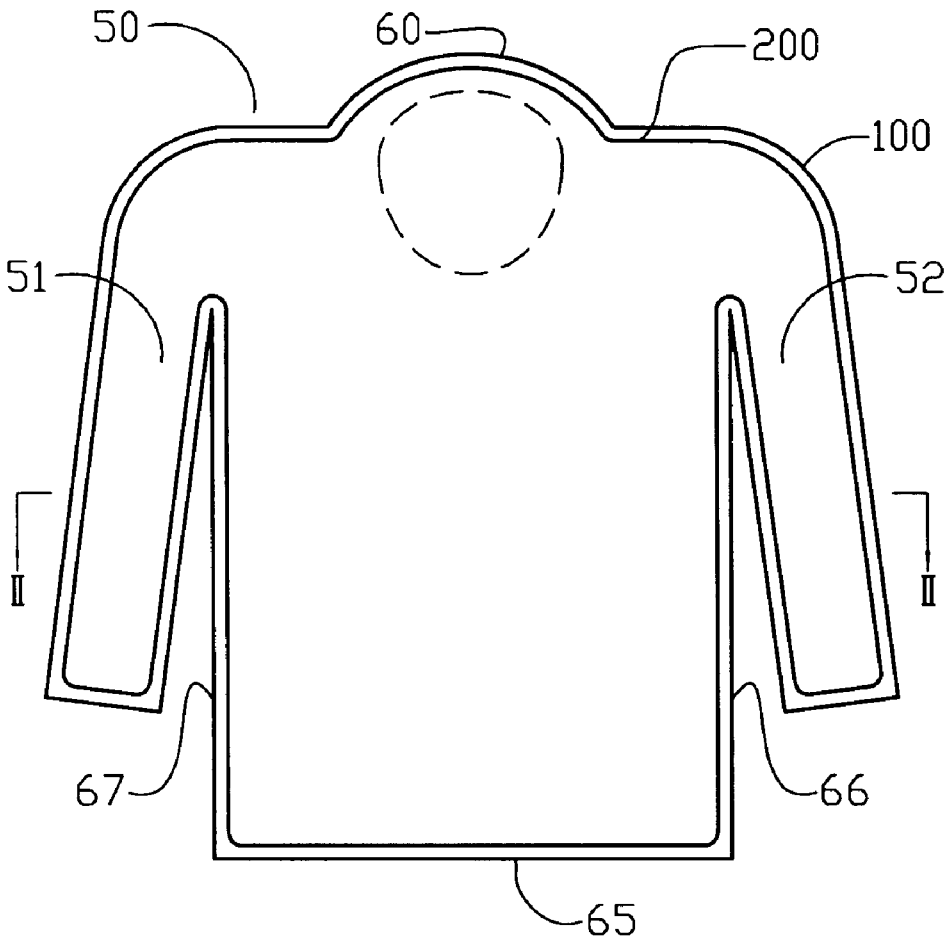
FIG. 4 is a rear view of an inner shell 100 of the four sided double reversible hunter's coat, according to the preferred embodiment of the present invention.

FIG. 3 and FIG. 4 show a rear view of the first shell 100 and second shell 200, respectively. As shown the shells are attached about the right side by a right seam 66 and about the left side by a left seam 67. When seamed along the sleeves 51, 52 and collar 60 the second shell 200 can rest directly within the first shell 100. The first shell 100 having an otherwise conventional back panel includes a central slit 300 formed vertically within the central area of the back panel. Affixed within this slit 300 is a reversible zipper 301 that allows the slit 300 to be opened or closed. As shown, no slit is formed in the second shell 200.

Figure 5:
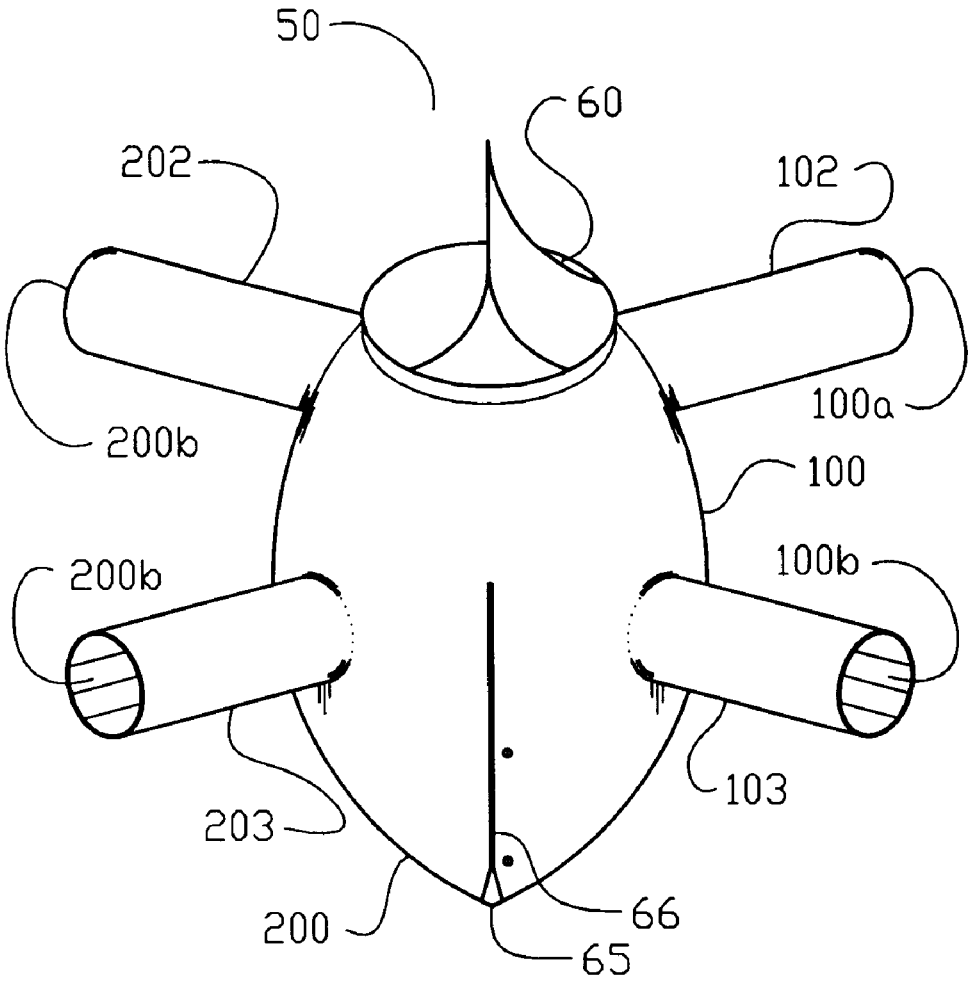
FIG. 5 is a cutaway front view of a four sided double reversible hunter's coat taken along line III—III of FIG. 3, according to the preferred embodiment of the present invention.
Figure 6:
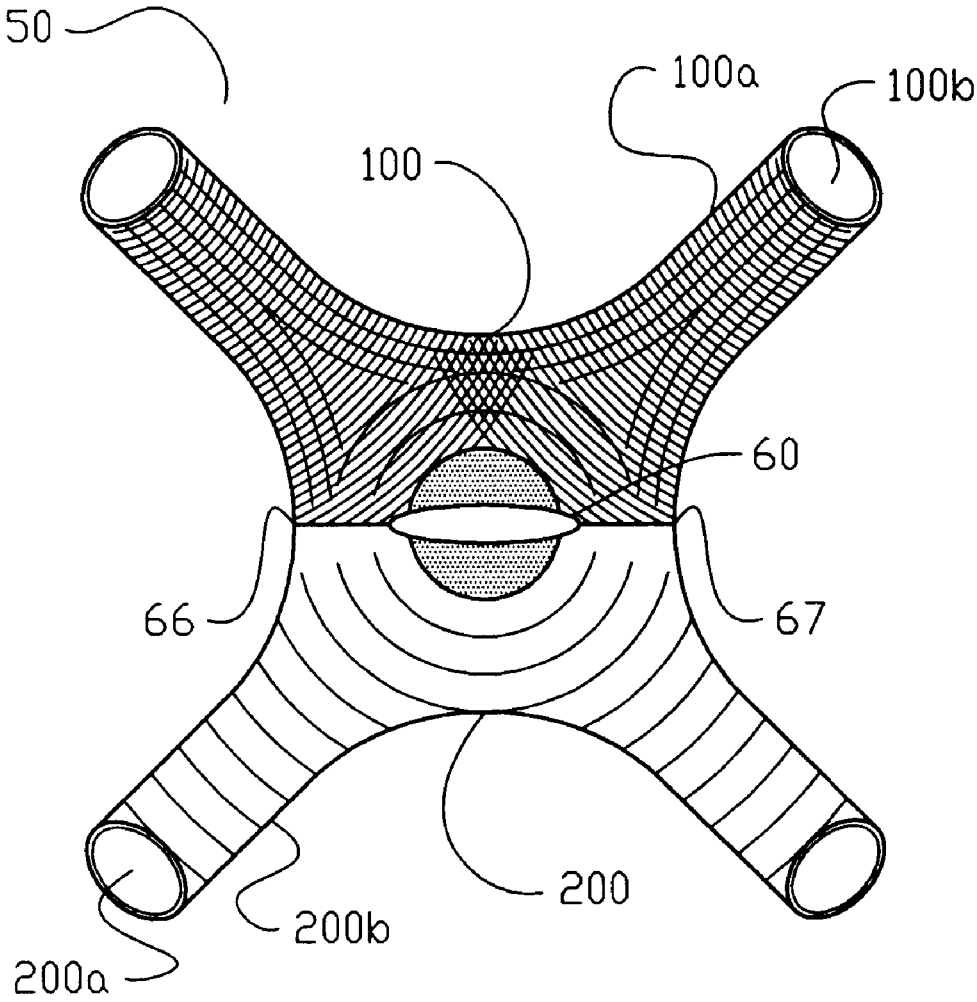
FIG. 6 is a perspective view of a four sided double reversible hunter's coat showing how the inner shell is pulled through the outer shell, according to the preferred embodiment of the present invention.

According to FIG. 5 and FIG. 6, a cutaway front view and top perspective of a four sided double reversible hunter's coat showing how the inner shell is pulled through the outer shell are shown, respectively. As shown, the first shell 100 is affixed to the second shell 200 about their periphery by a lower seam 65, right seam 66, left seam 67, and along the collar 60 only. In this manner, the first shell 100 can be pulled inside out, as shown, from the second shell 200 in the manner shown such that the first shell right arm 103 can be pulled from, (or optionally inserted within) the second shell right arm 203. Similarly, the first shell left arm 102 can be pulled from, (or optionally inserted within) the second shell left arm 202.

2. Operation of the Preferred Embodiment

To use the present invention, the four-sided double reversible coat 50 is worn as any otherwise conventional coat. However, upon the desire to change the external appearance of the coat 50, the user can merely reverse the coat to make the interior surface visibly available. This allows for easy access to two of the four camouflage patterns.

Should the user desire visible access to either of the two camouflage patterns that are directed inside the seamed area, the user opens the zipper 301 allowing the slit 300 to open. At this point, the coat can be turned inside out and pulled through the slit 300, making available the third and fourth camouflage patterns. The user can thereby select from the two newly-available outer surfaces.

The foregoing description is included to illustrate the operation of the preferred embodiment and is not meant to limit the scope of the invention. The scope of the invention is to be limited only by the following claims.

What is claimed is:

1. A four-sided double reversible coat comprising:

a first shell having a first outer surface opposite a first inner surface, said first outer surface having a first camouflage pattern and said first inner surface having a second camouflage pattern;

a second shell having a second outer surface opposite a second inner surface, said second outer surface having a third camouflage pattern and said second inner surface having a fourth camouflage pattern, said second shell having a back panel forming a central, vertical, single linear slit; and a reversible zipper attached within said slit; and wherein said first shell is affixed around a first shell periphery to said second shell around a second shell periphery.

2. The four-sided double reversible coat of claim 1, wherein:

said first camouflage pattern comprises a tan summer camouflage pattern;

said second camouflage pattern comprises a green forest camouflage pattern;

said third camouflage pattern comprises a white winter camouflage pattern; and said fourth camouflage pattern comprises a bright safety orange camouflage pattern.

3. The four-sided double reversible coat of claim 1, further comprising an upper pocket, each upper pocket formed of:

a patch affixed to the outer surface of the first shell attached over an orifice penetrating the outer shell and sealed on three sides and having with a pocket flap attached along an upper opening such as to fold downward over said upper opening; and a patch affixed to the inner surface of the first shell attached over an orifice penetrating the inner shell and sealed on three sides and having with a pocket flap attached along an upper opening such as to fold downward over said upper opening.

4. The four-sided double reversible coat of claim 3, further comprising a second upper pocket, each second upper pocket formed of:

a patch affixed to the outer surface of the second shell attached over an orifice penetrating the second shell and sealed on three sides and having with a pocket flap attached along an upper opening such as to fold downward over said upper opening;

a patch affixed to the inner surface of the second shell attached over an orifice penetrating the second shell and sealed on three sides and having with a pocket flap attached along an upper opening such as to fold downward over said upper opening, and wherein each upper pocket has outer access to a common inner pocket volume regardless of which surface is positioned to the outside.

5. The four-sided double reversible coat of claim 3, further comprising a lower pocket, each lower pocket formed of:

a patch affixed to the outer surface of the first shell attached over an orifice penetrating the outer shell and sealed on three sides and having with a pocket flap attached along an upper opening such as to fold downward over said upper opening; and a patch affixed to the inner surface of the first shell attached over an orifice penetrating the inner shell and sealed on three sides and having with a pocket flap attached along an upper opening such as to fold downward over said upper opening.

6. The four-sided double reversible coat of claim 5, further comprising a second lower pocket, each second lower pocket formed of:

a patch affixed to the outer surface of the second shell attached over an orifice penetrating the second shell and sealed on three sides and having with a pocket flap attached along an upper opening such as to fold downward over said upper opening;

a patch affixed to the inner surface of the second shell attached over an orifice penetrating the second shell and sealed on three sides and having with a pocket flap attached along an upper opening such as to fold downward over said upper opening, and wherein each upper pocket has outer access to a common inner pocket volume regardless of which surface is positioned to the outside.

* * * * *